US010816278B2

(12) United States Patent
Lu et al.

(10) Patent No.: US 10,816,278 B2
(45) Date of Patent: Oct. 27, 2020

(54) FIN ASSEMBLY FOR HEAT EXCHANGER AND HEAT EXCHANGER HAVING THE FIN ASSEMBLY

(71) Applicant: Danfoss Micro Channel Heat Exchanger (Jiaxing) Co., Ltd., Zhejiang (CN)

(72) Inventors: Xiangxun Lu, Zhejiang (CN); Weijun Wu, Zhejiang (CN); Guangsheng Wu, Zhejiang (CN); Wenjian Wei, Zhejiang (CN)

(73) Assignee: Danfoss Micro Channel Heat Exchanger (Jiaxing) Co. Ltd., Zhejiang (CN)

( * ) Notice: Subject to any disclaimer, the term of this patent is extended or adjusted under 35 U.S.C. 154(b) by 266 days.

(21) Appl. No.: 15/744,342

(22) PCT Filed: Jul. 19, 2016

(86) PCT No.: PCT/CN2016/090431

§ 371 (c)(1),
(2) Date: Oct. 23, 2018

(87) PCT Pub. No.: WO2017/016414

PCT Pub. Date: Feb. 2, 2017

(65) Prior Publication Data

US 2019/0086160 A1 Mar. 21, 2019

(30) Foreign Application Priority Data

Jul. 29, 2015 (CN) ..... 2015 1 0455325

(51) Int. Cl.
*F28D 1/02* (2006.01)
*F28F 1/12* (2006.01)
(Continued)

(52) U.S. Cl.
CPC ..... *F28F 1/126* (2013.01); *F28F 1/22* (2013.01); *F28F 3/025* (2013.01); *F28F 3/027* (2013.01);
(Continued)

(58) Field of Classification Search
CPC .... F28F 3/025; F28F 3/027; F28F 3/04; F28F 1/126; F28F 1/22; F28F 1/128;
(Continued)

(56) References Cited

U.S. PATENT DOCUMENTS 3,045,979 A * 7/1962 Huggins ..... B21D 53/08 165/152
6,125,926 A 10/2000 Okamoto et al.
(Continued)

FOREIGN PATENT DOCUMENTS

CN 1858542 A 11/2006
CN 101995185 A 3/2011
(Continued)

OTHER PUBLICATIONS

Supplementary European Search Report for Serial No. EP 16 82 9780 dated Jan. 7, 2019.
(Continued)

*Primary Examiner* — Henry T Crenshaw
*Assistant Examiner* — Kamran Tavakoldavani
(74) *Attorney, Agent, or Firm* — McCormick, Paulding & Huber PLLC

(57) ABSTRACT

The present invention provides a fin assembly for a heat exchanger and a heat exchanger having the fin assembly. The fin assembly includes a plurality of fins each having a corrugated fin body formed by a plate. The plurality of fins are arranged side by side in a width direction of the fin assembly. Wave crests or wave troughs, on one side in a height direction of the fin assembly, of two adjacent ones of the plurality of fins are staggered by a predetermined distance relative to each other in a length direction of the fin assembly. With the fin assembly and the heat exchanger according to the present invention, for example, heat exchange performance of the heat exchanger can be improved.

29 Claims, 14 Drawing Sheets

(51) Int. Cl.
*F28F 3/02* (2006.01)
*F28F 3/04* (2006.01)
*F28F 1/22* (2006.01)

(52) U.S. Cl.
CPC ..... *F28F 3/04* (2013.01); *F28F 1/128* (2013.01); *F28F 2215/00* (2013.01)

(58) Field of Classification Search
CPC ..... F28F 1/105; F28F 1/12; F28F 1/14; F28F 1/16; F28F 1/122; F28F 2215/00
USPC ..... 165/152, 171, 179, 181
See application file for complete search history.

(56) References Cited

U.S. PATENT DOCUMENTS

| | | | | |
|---|---|---|---|---|
| 6,213,196 | B1 | 4/2001 | Ozaki et al. | |
| 2012/0160451 | A1* | 6/2012 | Manter | B21D 53/04 165/96 |
| 2013/0087318 | A1* | 4/2013 | Nakano | F28F 1/126 165/181 |

FOREIGN PATENT DOCUMENTS

| | | | | | |
|---|---|---|---|---|---|
| CN | 103389001 | A | | 11/2013 | |
| CN | 203572292 | U | | 4/2014 | |
| CN | 204202451 | U | | 3/2015 | |
| CN | 204286173 | U | | 4/2015 | |
| CN | 204924000 | U | | 12/2015 | |
| FR | 2785978 | A1 | | 5/2000 | |
| JP | H0961081 | A | | 3/1997 | |
| JP | H10-300375 | A | | 11/1998 | |
| JP | 2004020108 | A | | 1/2004 | |
| JP | 2005061648 | A | | 3/2005 | |
| JP | 2013-142515 | A | * | 7/2013 | |
| JP | 2013142515 | A | * | 7/2013 | F28F 3/044 |
| WO | 2013/105490 | A1 | | 7/2013 | |
| WO | 2014054767 | A1 | | 4/2014 | |

OTHER PUBLICATIONS

International Search Report for Serial No. PCT/CN2016/090431 dated Oct. 31, 2016.
Translation of Notice of the Reason for Refusal for Japanese Patent Application No. 2018-503763 dated Jun. 26, 2020.

* cited by examiner

FIN ASSEMBLY FOR HEAT EXCHANGER AND HEAT EXCHANGER HAVING THE FIN ASSEMBLY

CROSS-REFERENCE TO RELATED APPLICATIONS

This application is a National Stage application of International Patent Application No. PCT/CN2016/090431, filed on Jul. 19, 2016, which claims priority to Chinese Patent Application No. 201510455325.3, filed on Jul. 29, 2015, each of which is hereby incorporated by reference in its entirety.

TECHNICAL FIELD

The present invention relates to a fin assembly for a heat exchanger and a heat exchanger having the fin assembly.

BACKGROUND

A heat exchanger such as a micro channel heat exchanger or a parallel flow evaporator comprises a fin assembly, and a heat exchange tube which may be a flat tube.

SUMMARY

An object of a disclosure of the present invention is to provide a fin assembly for a heat exchanger and a heat exchanger having the fin assembly, thereby, for example, improving heat exchange performance of the heat exchanger.

According to embodiments of the present invention, there is provided a fin assembly for a heat exchanger, the fin assembly comprising: a plurality of fins each having a corrugated fin body formed by a plate, the plurality of fins arranged side by side in a width direction of the fin assembly, wherein wave crests or wave troughs, on one side in a height direction of the fin assembly, of two adjacent ones of the plurality of fins are staggered by a predetermined distance relative to each other in a length direction of the fin assembly.

According to embodiments of the present invention, the two adjacent fins are connected to each other.

According to embodiments of the present invention, the plurality of fins are integrated.

According to embodiments of the present invention, the plurality of fins are formed out of the single plate.

According to embodiments of the present invention, the fin assembly for the heat exchanger further comprises: a connection part, and the connection part is arranged between the two adjacent fins to connect the two adjacent fins.

According to embodiments of the present invention, each fin body has a top defining the wave crest, a bottom defining the wave trough, and a middle extending between the top and the bottom, and the connection part is integrated with the middles of the two adjacent fins.

According to embodiments of the present invention, each fin body has a top defining the wave crest, a bottom defining the wave trough, and a middle extending between the top and the bottom and inclined to the length direction of the fin assembly, and the connection part is integrated with the middles of the two adjacent fins, and is in a position where the middles of the two adjacent fins intersect.

According to embodiments of the present invention, the connection part is arranged at an intermediate part of the middle in the height direction of the fin assembly.

According to embodiments of the present invention, the wave crest, on the one side in the height direction of the fin assembly, of one of the two adjacent fins and a wave trough, on the other side in the height direction of the fin assembly, of the other of the two adjacent fins are substantially arranged at the same position in the length direction of the fin assembly.

According to embodiments of the present invention, assuming that the plurality of fins are respectively numbered 1st to Nth from one to the other of outmost fins of the plurality of fins, distances by which the wave crests or the wave troughs, on the one side in the height direction of the fin assembly, of the 2nd to Nth fins are staggered relative to the wave crest or the wave trough, on the one side in the height direction of the fin assembly, of the 1st fin in the length direction of the fin assembly are gradually increased by a predetermined increment.

According to embodiments of the present invention, the predetermined increment is substantially a constant.

According to embodiments of the present invention, assuming that the plurality of fins are respectively numbered 1st to Nth from one to the other of outmost fins of the plurality of fins, and an average of distances between adjacent ones of the wave crests, on the one side in the height direction of the fin assembly, of the fin assembly is A, a distance by which the wave crest or the wave trough, on the one side in the height direction of the fin assembly, of the nth fin is staggered relative to the wave crest or the wave trough, on the one side in the height direction of the fin assembly, of the 1st fin in the length direction of the fin assembly is substantially $$\frac{1-(-1)^{(n+1)}}{2}\times\left(\frac{A}{2}\right)+(n-1)\times\frac{A}{N},$$

where n is a natural number that is greater than or equal to 2 and that is less than or equal to N.

According to embodiments of the present invention, at least two of the plurality of fins have different widths from each other.

According to embodiments of the present invention, at least one of the plurality of fins is provided with a louver.

According to embodiments of the present invention, in a section perpendicular to the height direction of the fin assembly, a surface of the fin body of at least one of the plurality of fins is inclined to the width direction of the fin assembly.

According to embodiments of the present invention, in a section perpendicular to the height direction of the fin assembly, surfaces of the fin bodies of at least some of the plurality of fins are inclined to the width direction of the fin assembly towards the same side in the length direction of the fin assembly.

According to embodiments of the present invention, in a section perpendicular to the height direction of the fin assembly, a surface of the fin body of at least one, on one side in the width direction of the fin assembly, of the plurality of fins is inclined to the width direction of the fin assembly towards one side in the length direction of the fin assembly, while a surface of the fin body of at least one, on the other side in the width direction of the fin assembly, of the plurality of fins is inclined to the width direction of the fin assembly towards the other side in the length direction of the fin assembly.

According to embodiments of the present invention, in a section perpendicular to the height direction of the fin assembly, a surface of the fin body of one of the two adjacent fins is inclined to the width direction of the fin assembly towards one side in the length direction of the fin assembly, while a surface of the fin body of the other of the two adjacent fins is inclined to the width direction of the fin assembly towards the other side in the length direction of the fin assembly.

According to embodiments of the present invention, assuming that the plurality of fins are respectively numbered 1st to Nth from one to the other of outmost fins of the plurality of fins, a distance by which the wave crest or the wave trough, on the one side in the height direction of the fin assembly, of the ith fin is staggered relative to the wave crest or the wave trough, on the one side in the height direction of the fin assembly, of the 1st fin in the length direction of the fin assembly is gradually increased by a predetermined increment, and the wave crest, on the one side in the height direction of the fin assembly, of one of the j-1th and jth fins and a wave trough, on the other side in the height direction of the fin assembly, of the other of the j-1th and jth fins are substantially arranged at the same position in the length direction of the fin assembly, where i is an odd number that is greater than or equal to 3 and that is less than or equal to N, while j is an even number that is greater than or equal to 2 and that is less than or equal to N.

According to embodiments of the present invention, the predetermined increment is substantially a constant.

According to embodiments of the present invention, assuming that the plurality of fins are respectively numbered 1st to Nth from one to the other of outmost fins of the plurality of fins, the wave crest or the wave trough, on the one side in the height direction of the fin assembly, of the ith fin is staggered by a preset distance relative to the wave crest or the wave trough, on the one side in the height direction of the fin assembly, of the 1st fin in the length direction of the fin assembly, and the wave crest, on the one side in the height direction of the fin assembly, of one of the j-1th and jth fins and a wave trough, on the other side in the height direction of the fin assembly, of the other of the j-1th and jth fins are substantially arranged at the same position in the length direction of the fin assembly, where i is an odd number that is greater than or equal to 3 and that is less than or equal to N, while j is an even number that is greater than or equal to 2 and that is less than or equal to N.

According to embodiments of the present invention, the distance by which the wave crest or the wave trough, on the one side in the height direction of the fin assembly, of the ith fin is staggered relative to the wave crest or the wave trough, on the one side in the height direction of the fin assembly, of the 1st fin in the length direction of the fin assembly is $$(i-1)\times\frac{A}{N},$$

where A is an average of distances between adjacent ones of the wave crests, on the one side in the height direction of the fin assembly, of the fin assembly.

According to embodiments of the present invention, the wave crests or the wave troughs, on the one side in the height direction of the fin assembly, of all of the plurality of fins are staggered by the predetermined distances relative to one another in the length direction of the fin assembly.

According to embodiments of the present invention, projections of the wave crests or the wave troughs, on the one side in the height direction of the fin assembly, of all of the plurality of fins on a plane defined by the height direction and the length direction of the fin assembly are arranged at substantially equal intervals in the length direction of the fin assembly.

According to embodiments of the present invention, at least one of the plurality of fins is provided with no louver.

According to embodiments of the present invention, the plurality of fins are three or more fins.

According to embodiments of the present invention, the fin has a sectional shape in a plane that is substantially perpendicular to a surface of the plate of the fin, and at least some of the plurality of fins have substantially the same sectional shape.

According to embodiments of the present invention, the fin has a sectional shape in a plane that is defined by the height direction and the length direction of the fin assembly, and at least some of the plurality of fins have substantially the same sectional shape.

According to embodiments of the present invention, there is provided a heat exchanger comprising: heat exchange tubes; and the abovementioned fin assemblies disposed between the heat exchange tubes.

With the fin assembly and the heat exchanger according to the present invention, for example, heat exchange performance of the heat exchanger can be improved.

DETAILED DESCRIPTION

Figure 1:
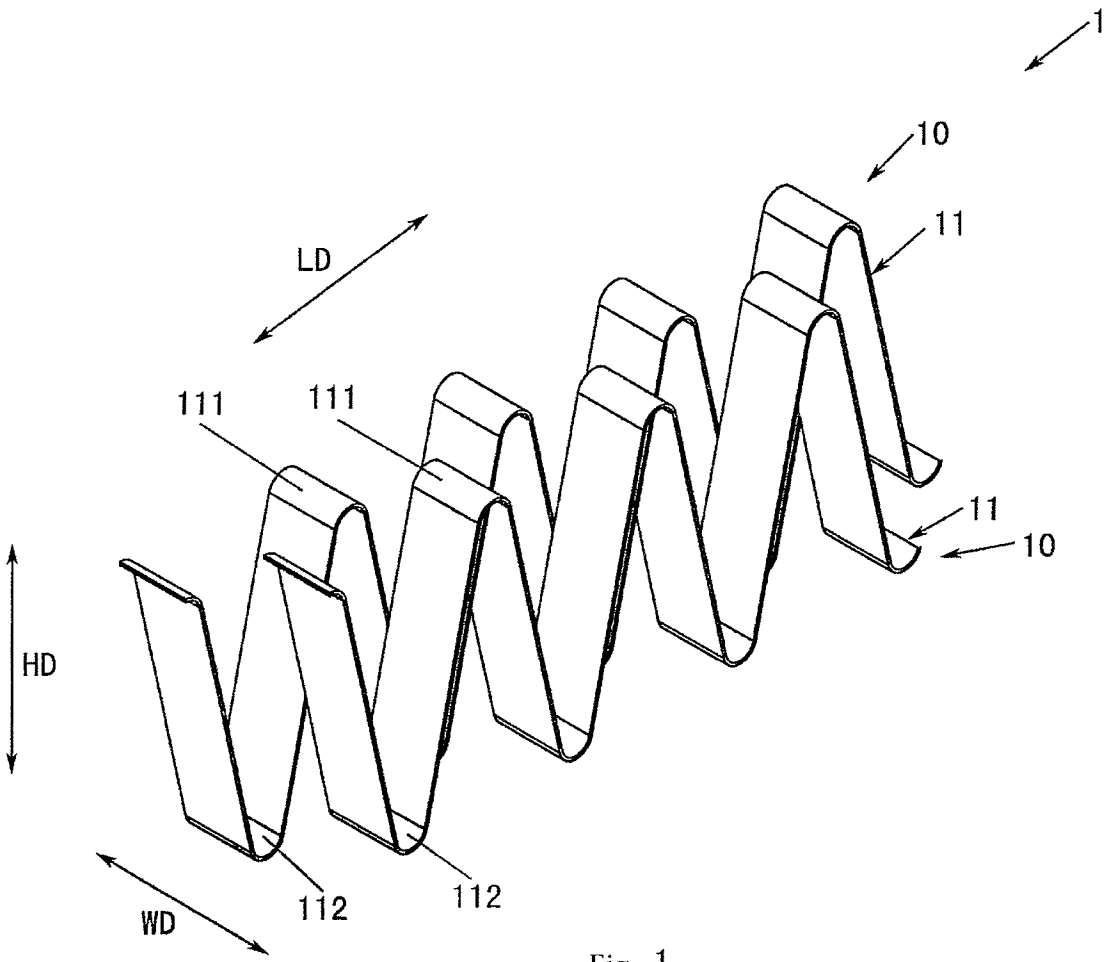
FIG. 1 is a schematic perspective view of a fin assembly according to a first embodiment of the present invention.
Figure 2:
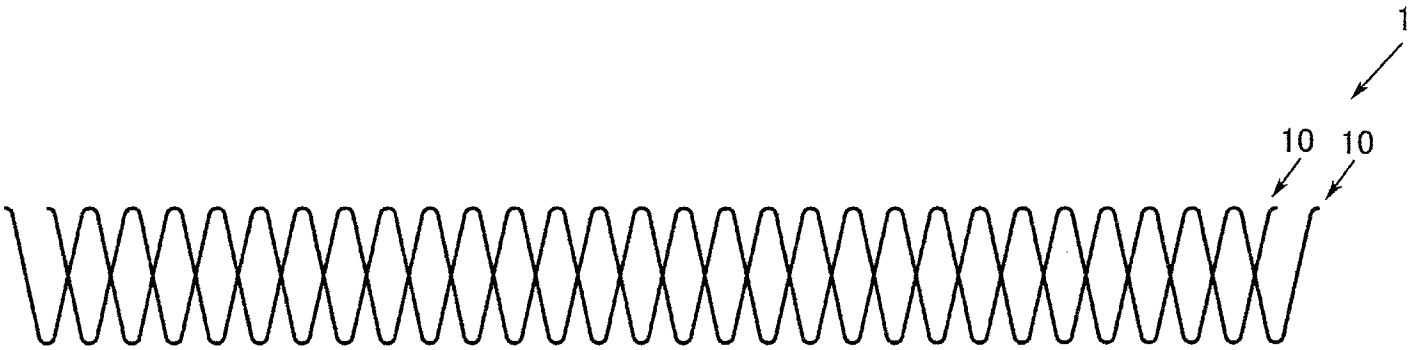
FIG. 2 is a schematic side view of the fin assembly according to the first embodiment of the present invention.
Figure 3:
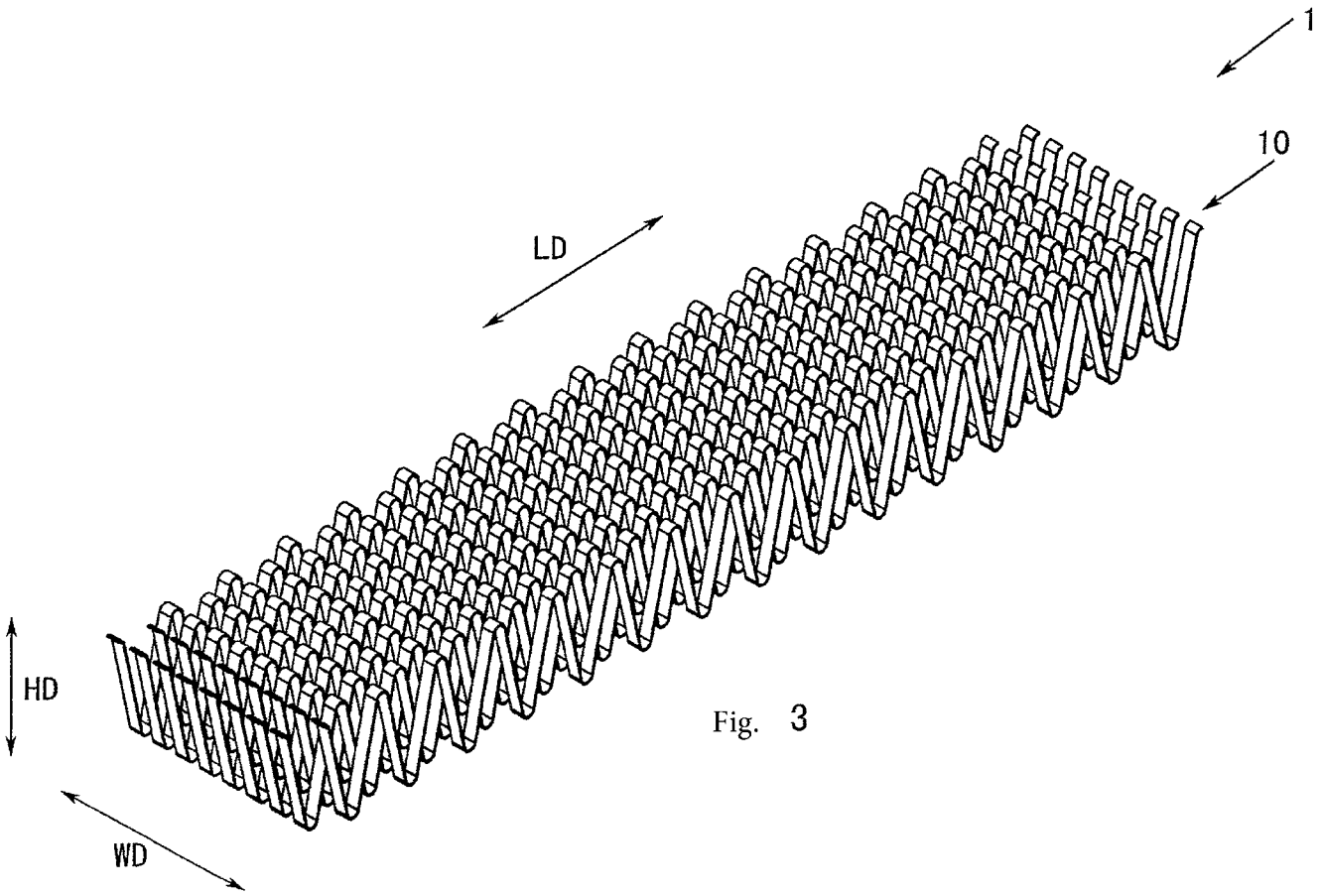
FIG. 3 is another schematic perspective view of the fin assembly according to the first embodiment of the present invention.

A further description of the invention will be made as below with reference to embodiments of the present invention taken in conjunction with the accompanying drawings.

Referring to FIG. 1 to FIG. 18, a heat exchanger according to embodiments of the present invention comprises: heat exchange tubes; and fin assemblies 1 disposed between the heat exchange tubes.

Referring to FIG. 1 to FIG. 18, the fin assembly 1 comprises: a plurality of fins 10 each having a corrugated fin body 11 formed by a plate. The plurality of fins 10 are arranged side by side in a width direction WD of the fin assembly 1. Wave crests 111 or wave troughs 112, on one side in a height direction HD of the fin assembly 1, of two adjacent ones of the plurality of fins 10 are staggered by a predetermined distance relative to each other in a length direction LD of the fin assembly 1. For example, the plurality of fins 10 may be three or more fins 10.

According to embodiments of the present invention, the fin 10 has a sectional shape in a plane that is substantially perpendicular to a surface of the plate (or a wave-shaped plate) of the fin 10, and at least some (for example all) of the plurality of fins 10 have substantially the same sectional shape. Alternatively, at least some (for example all) of the plurality of fins 10 may have different sectional shapes. For example, in a horizontal plane, the plate (or the wave-shaped plate) of the fin 10 or the surface of the plate (or the wave-shaped plate) of the fin 10 is a straight line, and the plane that is substantially perpendicular to the surface of the plate (or the wave-shaped plate) of the fin 10 is perpendicular to the straight line.

According to embodiments of the present invention, the fin 10 has a sectional shape in a plane that is defined by the height direction HD and the length direction LD of the fin assembly 1, and at least some (for example all) of the plurality of fins 10 have substantially the same sectional shape. Alternatively, at least some (for example all) of the plurality of fins 10 may have different sectional shapes.

Figure 8:
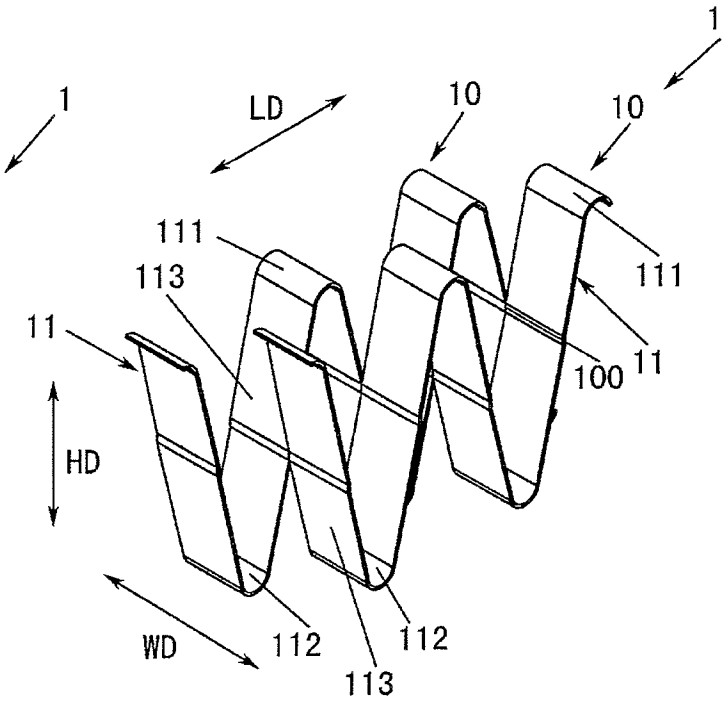
FIG. 8 is a schematic perspective view of the fin assembly according to a fourth embodiment of the present invention.
Figure 7:
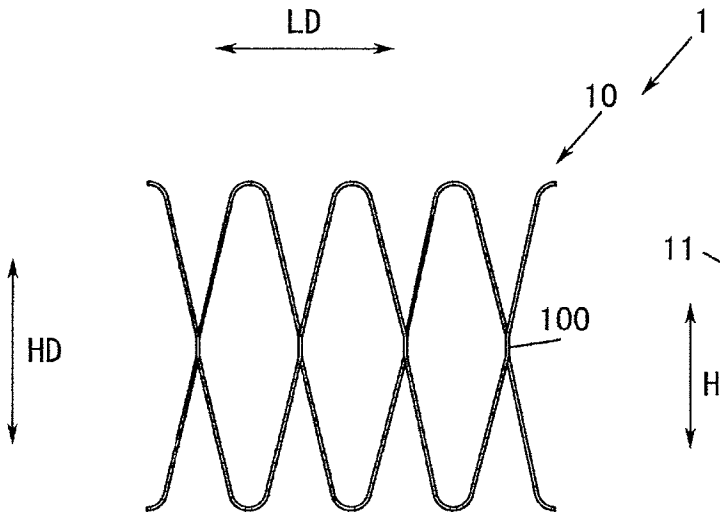
FIG. 7 is a schematic side view of a fin assembly according to a fourth embodiment of the present invention.

Referring to FIG. 7 and FIG. 8, according to embodiments of the present invention, the two adjacent fins 10 are connected to each other. The plurality of fins 10 may be integrated. The plurality of fins 10 may be formed out of the single plate. With the integrated fin assembly, assembling can be facilitated. In addition, the plurality of fins 10 may also be soldered together.

Referring to FIG. 7 and FIG. 8, according to an example of the present invention, the fin assembly 1 further comprises: a connection part 100. The connection part 100 is arranged between the two adjacent fins 10 to connect the two adjacent fins 10.

Referring to FIG. 7 and FIG. 8, according to some embodiments of the present invention, each fin body 11 has a top defining the wave crest 111, a bottom defining the wave trough 112, and a middle 113 extending between the top and the bottom, and the connection part 100 is integrated with the middles 113 of the two adjacent fins 10.

Referring to FIG. 7 and FIG. 8, according to some other embodiments of the present invention, each fin body 11 has a top defining the wave crest 111, a bottom defining the wave trough 112, and a middle 113 extending between the top and the bottom and inclined to the length direction LD of the fin assembly 1, and the connection part 100 is integrated with the middles 113 of the two adjacent fins 10, and is in a position where the middles 113 of the two adjacent fins 10 intersect.

Referring to FIG. 7 and FIG. 8, according to embodiments of the present invention, the connection part 100 is arranged at an intermediate part or an intermediate point of the middle 113 in the height direction HD of the fin assembly 1.

Referring to FIGS. 1-3 and FIGS. 7-8, according to embodiments of the present invention, the wave crest 111, on the one side in the height direction HD of the fin assembly 1, of one of the two adjacent fins 10 and a wave trough 112, on the other side in the height direction HD of the fin assembly 1, of the other of the two adjacent fins 10 are substantially arranged at the same position in the length direction LD of the fin assembly 1.

Figure 4:
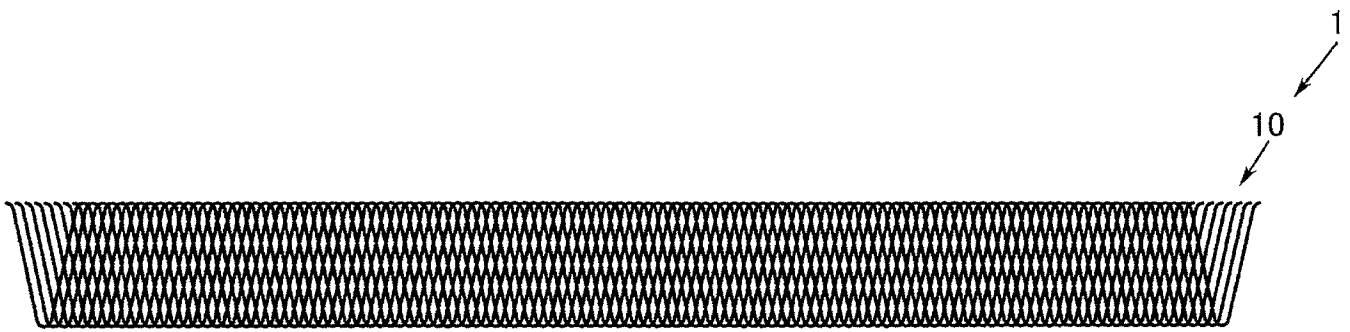
FIG. 4 is a schematic side view of a fin assembly according to a second embodiment of the present invention.
Figure 5:
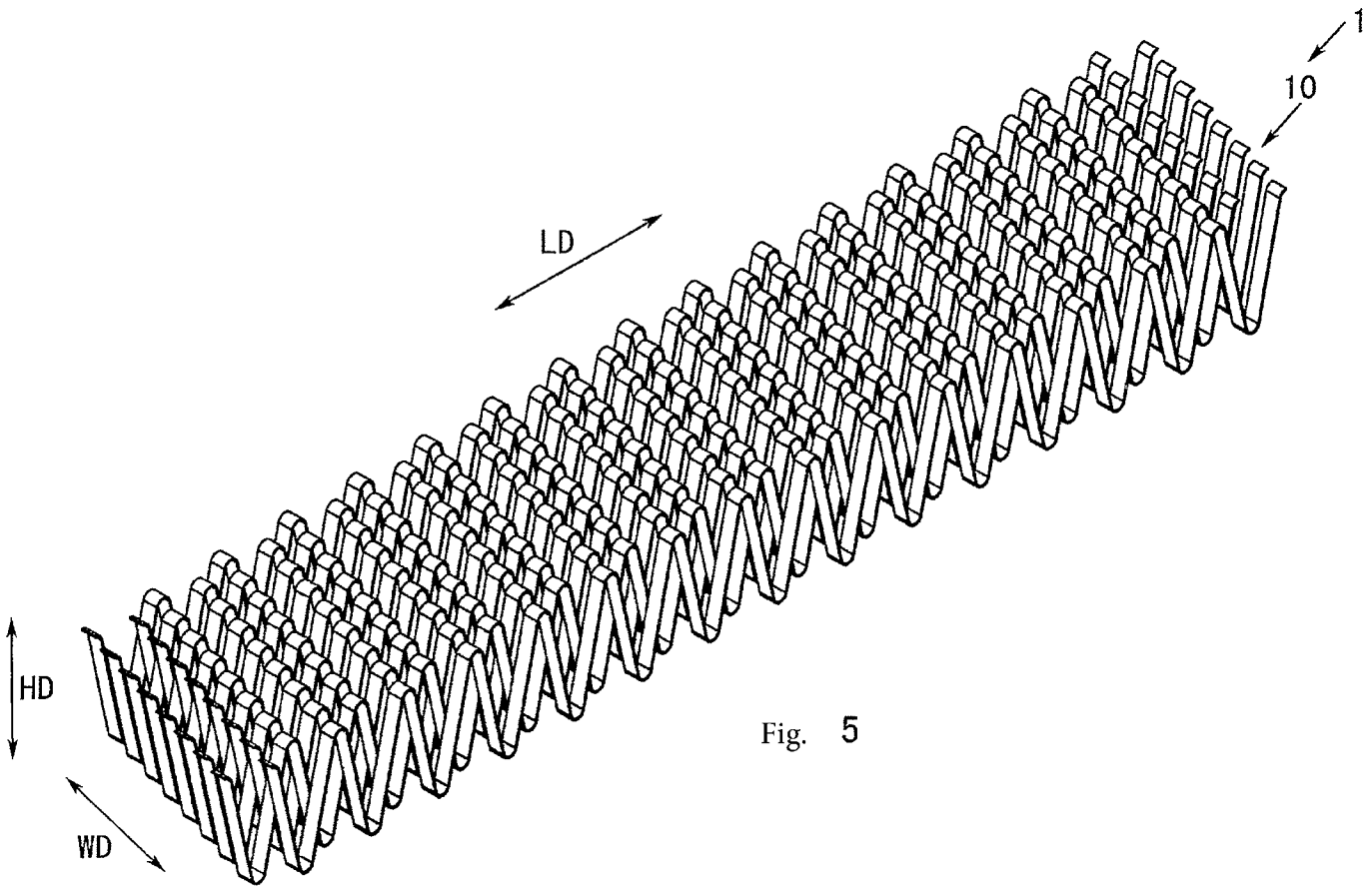
FIG. 5 is a schematic perspective view of the fin assembly according to the second embodiment of the present invention.
Figure 6:
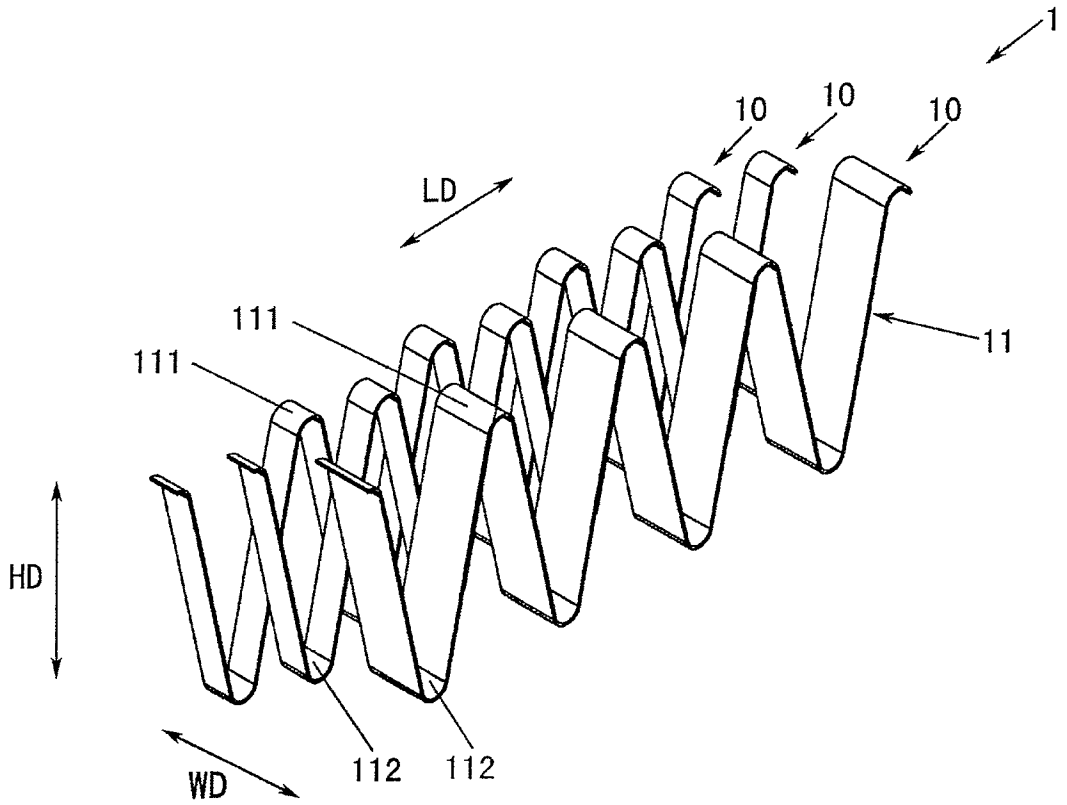
FIG. 6 is a schematic perspective view of a fin assembly according to a third embodiment of the present invention.

Referring to FIG. 4 to FIG. 6, according to embodiments of the present invention, assuming that the plurality of fins 10 are respectively numbered 1st to Nth from one to the other of outmost fins 10 of the plurality of fins 10, distances by which the wave crests 111 or the wave troughs 112, on the one side in the height direction HD of the fin assembly 1, of the 2nd to Nth fins 10 are staggered relative to the wave crest 111 or the wave trough 112, on the one side in the height direction HD of the fin assembly 1, of the 1st fin 10 in the length direction LD of the fin assembly 1 are gradually increased by a predetermined increment. For example, the predetermined increment is substantially a constant or a variable.

Referring to FIG. 4 to FIG. 6, according to embodiments of the present invention, assuming that the plurality of fins 10 are respectively numbered 1st to Nth from one to the other of outmost fins 10 of the plurality of fins 10, and an average of distances between adjacent ones of the wave crests 111, on the one side in the height direction HD of the fin assembly 1, of the fin assembly 1 is A, a distance by which the wave crest 111 or the wave trough 112, on the one side in the height direction HD of the fin assembly 1, of the nth fin 10 is staggered relative to the wave crest 111 or the wave trough 112, on the one side in the height direction HD of the fin assembly 1, of the 1st fin 10 in the length direction LD of the fin assembly 1 is substantially $$\frac{1-(-1)^{(n+1)}}{2}\times\left(\frac{A}{2}\right)+(n-1)\times\frac{A}{N},$$

where n is a natural number that is greater than or equal to 2 and that is less than or equal to N.

According to embodiments of the present invention, assuming that the plurality of fins 10 are respectively numbered 1st to Nth from one to the other of outmost fins 10 of the plurality of fins 10, a distance by which the wave crest 111 or the wave trough 112, on the one side in the height direction HD of the fin assembly 1, of the ith fin 10 is staggered relative to the wave crest 111 or the wave trough 112, on the one side in the height direction HD of the fin assembly 1, of the 1st fin 10 in the length direction LD of the fin assembly 1 is gradually increased by a predetermined increment, and the wave crest 111, on the one side in the height direction HD of the fin assembly 1, of one of the j-1th and jth fins 10 and a wave trough 112, on the other side in the height direction HD of the fin assembly 1, of the other of the j-1th and jth fins 10 are substantially arranged at the same position in the length direction LD of the fin assembly 1, where i is an odd number that is greater than or equal to 3 and that is less than or equal to N, while j is an even number that is greater than or equal to 2 and that is less than or equal to N. For example, the predetermined increment is substantially a constant.

According to embodiments of the present invention, assuming that the plurality of fins 10 are respectively numbered 1st to Nth from one to the other of outmost fins 10 of the plurality of fins 10, the wave crest 111 or the wave trough 112, on the one side in the height direction HD of the fin assembly 1, of the ith fin 10 is staggered by a preset distance relative to the wave crest 111 or the wave trough 112, on the one side in the height direction HD of the fin assembly 1, of the 1st fin 10 in the length direction LD of the fin assembly 1, and the wave crest 111, on the one side in the height direction HD of the fin assembly 1, of one of the j-1th and jth fins 10 and a wave trough 112, on the other side in the height direction HD of the fin assembly 1, of the other of the j-1th and jth fins 10 are substantially arranged at the same position in the length direction LD of the fin assembly 1, where i is an odd number that is greater than or equal to 3 and that is less than or equal to N, while j is an even number that is greater than or equal to 2 and that is less than or equal to N. For example, the distance by which the wave crest 111 or the wave trough 112, on the one side in the height direction HD of the fin assembly 1, of the ith fin 10 is staggered relative to the wave crest 111 or the wave trough 112, on the one side in the height direction HD of the fin assembly 1, of the 1st fin 10 in the length direction LD of the fin assembly 1 is $$(i-1)\times\frac{A}{N},$$

where A is an average of distances between adjacent ones of the wave crests 111, on the one side in the height direction HD of the fin assembly 1, of the fin assembly 1.

According to embodiments of the present invention, the wave crests 111 or the wave troughs 112, on the one side in the height direction HD of the fin assembly 1, of all of the plurality of fins 10 are staggered by the predetermined distances relative to one another in the length direction LD of the fin assembly 1.

According to embodiments of the present invention, projections of the wave crests 111 or the wave troughs 112, on the one side in the height direction HD of the fin assembly 1, of all of the plurality of fins 10 on a plane defined by the height direction HD and the length direction LD of the fin assembly 1 are arranged at substantially equal intervals in the length direction LD of the fin assembly 1.

Referring to FIG. 6, according to embodiments of the present invention, at least two of the plurality of fins 10 have different widths from each other. For example, widths of the plurality of fins 10 are gradually decreased from one to the other of outmost fins of the plurality of fins 10. In addition, each fin assembly 1 may have other different structural parameters depending on an application.

Figure 9:
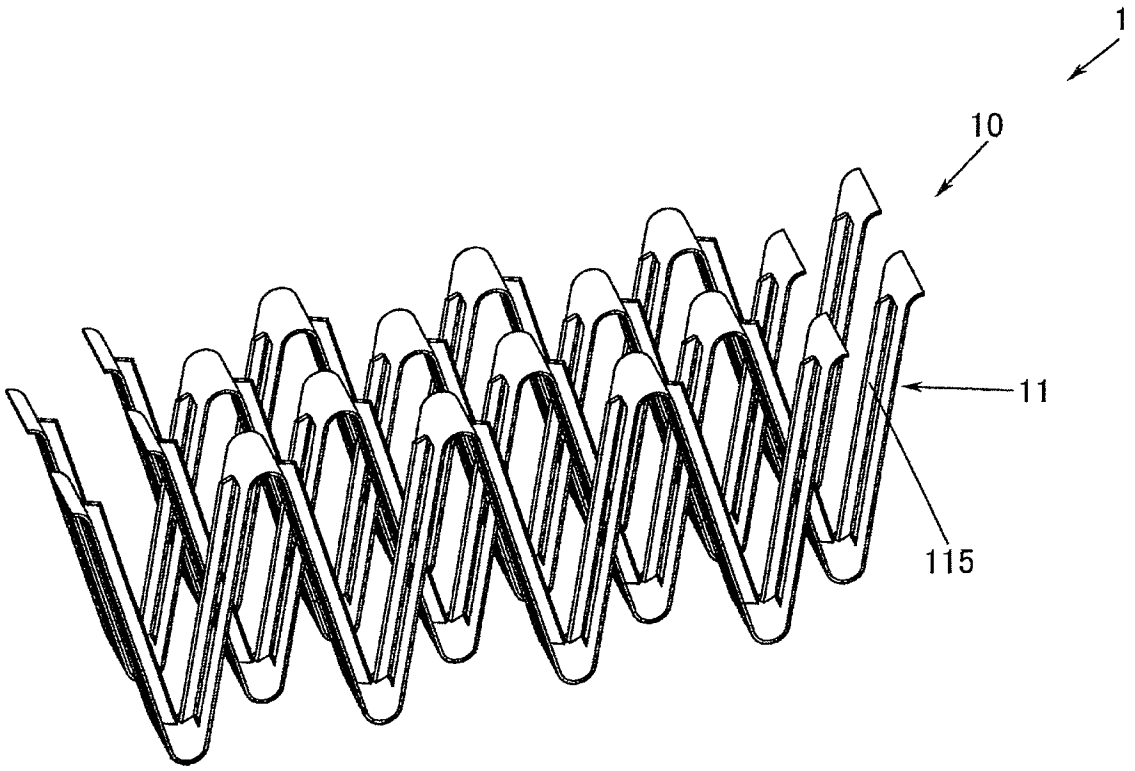
FIG. 9 is a schematic perspective view of a fin assembly according to a fifth embodiment of the present invention.

Referring to FIG. 9, according to embodiments of the present invention, at least one of the plurality of fins 10 is provided with a louver 115. Alternatively, the plurality of fins 10 may be provided with no louver 115. For example, at least one of the plurality of fins 10 is provided with no louver 115. Referring to FIG. 10 to FIG. 18, according to embodiments of the present invention, in a section perpendicular to the height direction HD of the fin assembly 1, a surface of the fin body 11 of at least one of the plurality of fins 10 is inclined to the width direction WD of the fin assembly 1. For example, the section may be between the wave crest 111 and the wave trough 112, for example in the middle 113. With the inclined fins, a wind field can be guided and an air circulating path can be enlarged while a face area is increased.

Figure 10:
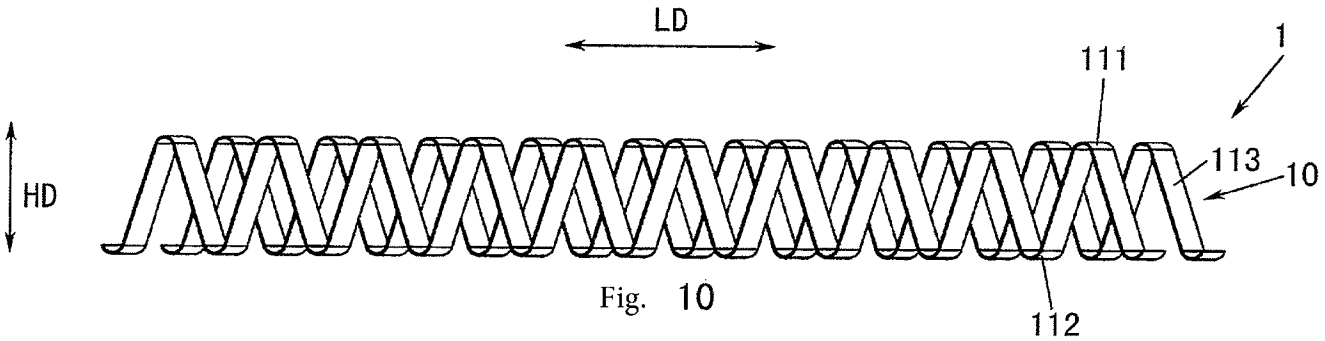
FIG. 10 is a schematic perspective view of a fin assembly according to a sixth embodiment of the present invention.
Figure 11:
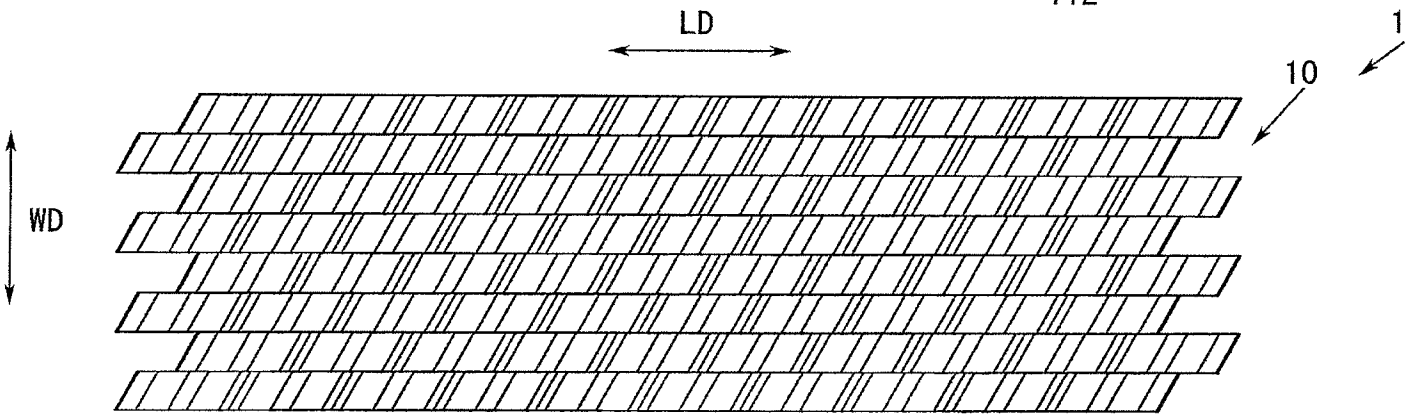
FIG. 11 is a schematic top view of the fin assembly according to the sixth embodiment of the present invention.
Figure 12:
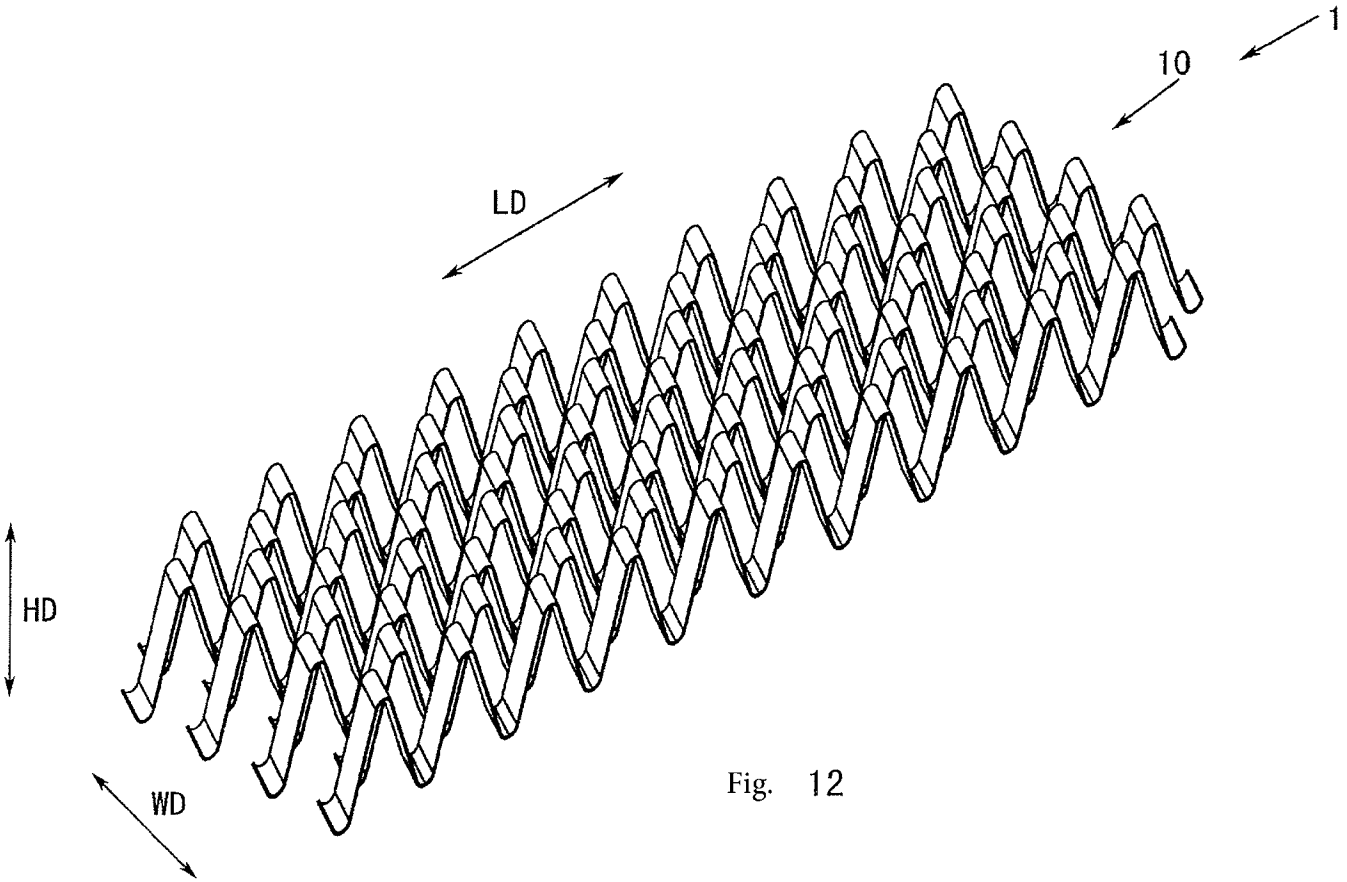
FIG. 12 is another schematic perspective view of the fin assembly according to the sixth embodiment of the present invention.

Referring to FIG. 10 to FIG. 12, according to embodiments of the present invention, in a section perpendicular to the height direction HD of the fin assembly 1, surfaces of the fin bodies 11 of at least some of the plurality of fins 10 are inclined to the width direction WD of the fin assembly 1 towards the same side in the length direction LD of the fin assembly 1.

Figure 13:
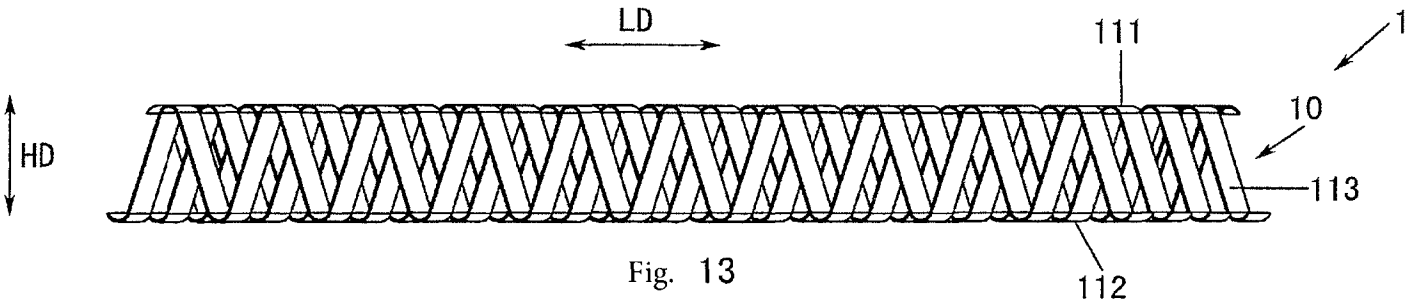
FIG. 13 is a schematic perspective view of a fin assembly according to a seventh embodiment of the present invention.
Figure 14:
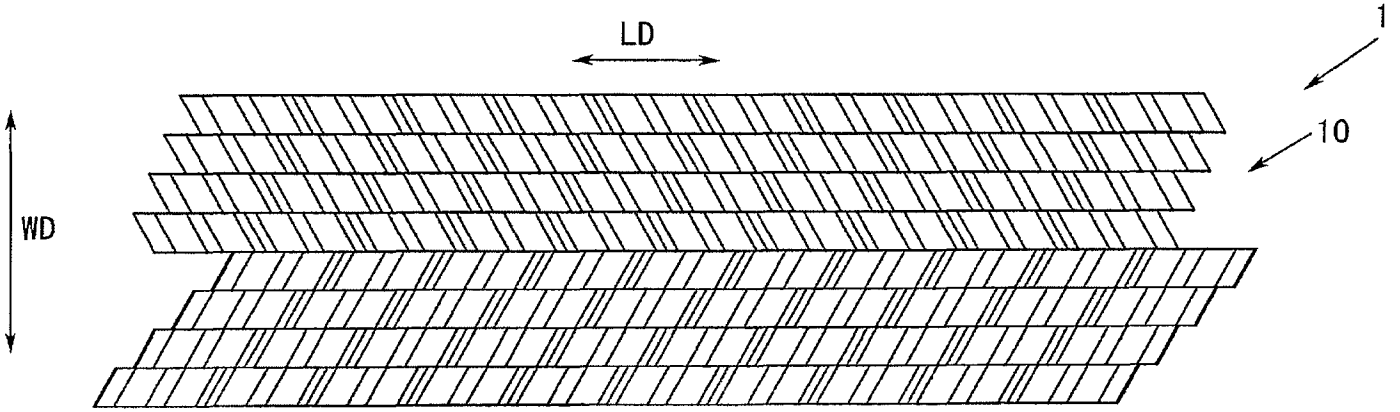
FIG. 14 is a schematic top view of the fin assembly according to the seventh embodiment of the present invention.
Figure 15:
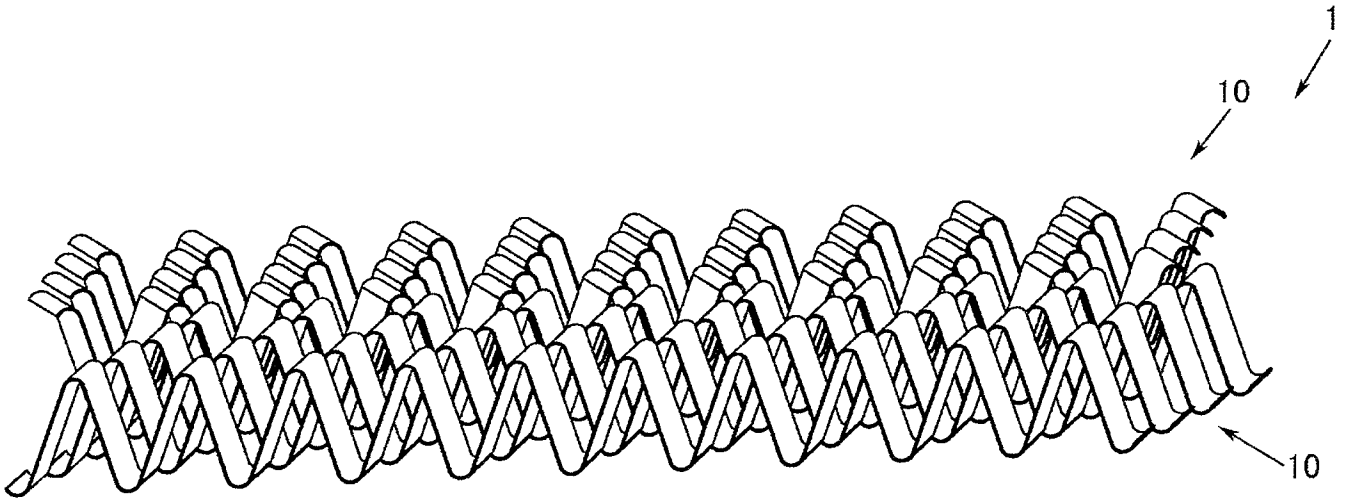
FIG. 15 is another schematic perspective view of the fin assembly according to the seventh embodiment of the present invention.

Referring to FIG. 13 to FIG. 15, according to embodiments of the present invention, in a section perpendicular to the height direction HD of the fin assembly 1, a surface of the fin body 11 of at least one (for example one half of the plurality of fins 10), on one side in the width direction WD of the fin assembly 1, of the plurality of fins 10 is inclined to the width direction WD of the fin assembly 1 towards one side in the length direction LD of the fin assembly 1, while a surface of the fin body 11 of at least one (for example the other half of the plurality of fins 10), on the other side in the width direction WD of the fin assembly 1, of the plurality of fins 10 is inclined to the width direction WD of the fin assembly 1 towards the other side in the length direction LD of the fin assembly 1. With the different inclination directions, a better heat exchange effect can be achieved.

Figure 16:
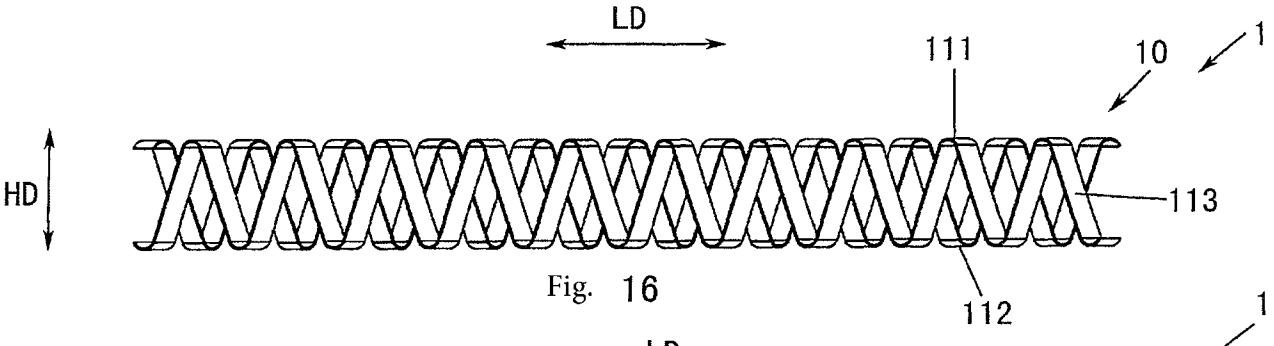
FIG. 16 is a schematic perspective view of a fin assembly according to an eighth embodiment of the present invention.
Figure 17:
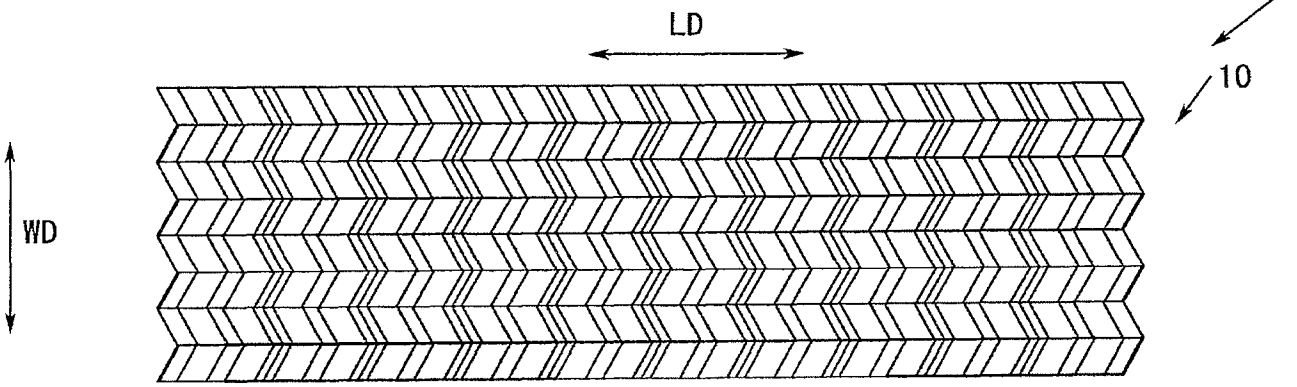
FIG. 17 is a schematic top view of the fin assembly according to the eighth embodiment of the present invention.
Figure 18:
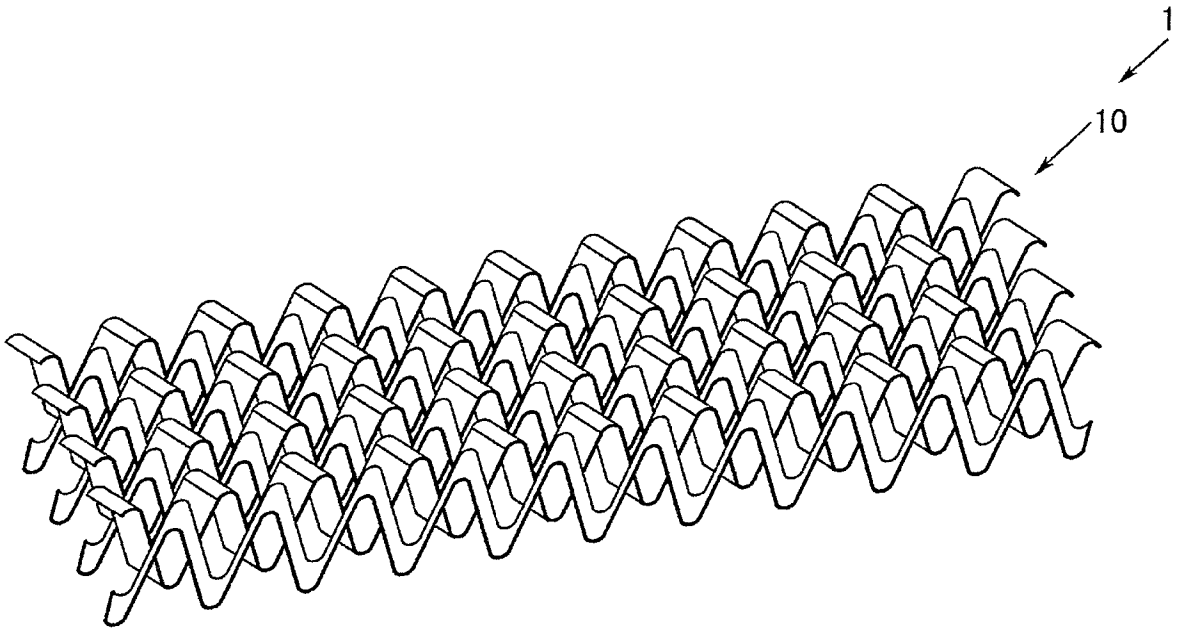
FIG. 18 is another schematic perspective view of the fin assembly according to the eighth embodiment of the present invention.

Referring to FIG. 16 to FIG. 18, according to embodiments of the present invention, in a section perpendicular to the height direction HD of the fin assembly 1, a surface of the fin body 11 of one of the two adjacent fins 10 is inclined to the width direction WD of the fin assembly 1 towards one side in the length direction LD of the fin assembly 1, while a surface of the fin body 11 of the other of the two adjacent fins 10 is inclined to the width direction WD of the fin assembly 1 towards the other side in the length direction LD of the fin assembly 1.

The fin assembly and the heat exchanger according to the embodiments of the present invention have a simple structure and effectively raise heat exchange efficiency of the fin, thereby reducing cost of the heat exchanger and increasing heat exchange capacity of the heat exchanger.

The fin assembly and the heat exchanger according to the embodiments of the present invention have a more fin face area when viewed from a side view, i.e. as can be seen from an air circulating direction of the heat exchanger. Since wind is sufficiently used, the heat exchange efficiency of the fin is increased.

In addition, with the fin assembly and the heat exchanger according to the embodiments of the present invention, a rear row of the fin assembly effectively uses wind leaked from the wave crest and the wave trough of a front row of the fin assembly.

In addition, with the fin assembly and the heat exchanger according to the embodiments of the present invention, a boundary layer occurring during heat exchange can be well broken by increasing the face area of the fin, thereby raising the heat exchange efficiency.

It should be noted that some or all of the technical features in the abovementioned embodiments may be combined with one another to form new embodiments.

What is claimed is:

1. A fin assembly for a heat exchanger, the fin assembly comprising:

a plurality of fins each having a corrugated fin body formed by a plate, the plurality of fins arranged side by side in a width direction of the fin assembly, wherein wave crests or wave troughs, on one side in a height direction of the fin assembly, of two adjacent ones of the plurality of fins are staggered by a predetermined distance relative to each other in a length direction of the fin assembly;

the fin assembly further comprising a connection part, the connection part arranged between the two adjacent fins to connect the two adjacent fins;

wherein each said fin body has a top defining the wave crest, a bottom defining the wave trough, and a middle extending between the top and the bottom and inclined to the length direction of the fin assembly, and the connection part is integrated with the middles of the two adjacent fins, and is in a position where the middles of the two adjacent fins intersect.

2. A fin assembly for a heat exchanger, the fin assembly comprising:

a plurality of fins each having a corrugated fin body formed by a plate, the plurality of fins arranged side by side in a width direction of the fin assembly, wherein wave crests or wave troughs, on one side in a height direction of the fin assembly, of two adjacent ones of the plurality of fins are staggered by a predetermined distance relative to each other in a length direction of the fin assembly; and wherein assuming that the plurality of fins are respectively numbered 1st to Nth from one to the other of outmost fins of the plurality of fins, distances by which the wave crests or the wave troughs, on the one side in the height direction of the fin assembly, of the 2nd to Nth fins are staggered relative to the wave crest or the wave trough, on the one side in the height direction of the fin assembly, of the 1st fin in the length direction of the fin assembly are gradually increased by a predetermined increment.

3. The fin assembly for the heat exchanger according to claim 2, wherein the predetermined increment is substantially a constant.

4. A fin assembly for a heat exchanger, the fin assembly comprising:

a plurality of fins each having a corrugated fin body formed by a plate, the plurality of fins arranged side by side in a width direction of the fin assembly;

wherein wave crests or wave troughs, on one side in a height direction of the fin assembly, of two adjacent ones of the plurality of fins are staggered by a predetermined distance relative to each other in a length direction of the fin assembly;

the fin assembly further comprising a connection part, the connection part arranged between the two adjacent fins to connect the two adjacent fins;

wherein each said fin body has a top defining the wave crest, a bottom defining the wave trough, and a middle extending between the top and the bottom; and wherein the connection part is integrated with the middles of the two adjacent fins.

5. The fin assembly for the heat exchanger according to claim 4, wherein in a section perpendicular to the height direction of the fin assembly, a surface of the fin body of at least one of the plurality of fins is inclined to the width direction of the fin assembly.

6. The fin assembly for the heat exchanger according to claim 4, wherein the two adjacent fins are connected to each other.

7. The fin assembly for the heat exchanger according to claim 4, wherein the plurality of fins are integrated.

8. The fin assembly for the heat exchanger according to claim 4, wherein the plurality of fins are formed out of the single plate.

9. The fin assembly for the heat exchanger according to claim 4, wherein the connection part is arranged at an intermediate part of the middle in the height direction of the fin assembly.

10. The fin assembly for the heat exchanger according to claim 4, wherein the wave crest, on the one side in the height direction of the fin assembly, of one of the two adjacent fins and a wave trough, on the other side in the height direction of the fin assembly, of the other of the two adjacent fins are substantially arranged at the same position in the length direction of the fin assembly.

11. The fin assembly for the heat exchanger according to claim 4, wherein assuming that the plurality of fins are respectively numbered 1st to Nth from one to the other of outmost fins of the plurality of fins, and an average of distances between adjacent ones of the wave crests, on the one side in the height direction of the fin assembly, of the fin assembly is A, a distance by which the wave crest or the wave trough, on the one side in the height direction of the fin assembly, of the nth fin is staggered relative to the wave crest or the wave trough, on the one side in the height direction of the fin assembly, of the 1st fin in the length direction of the fin assembly is substantially $$\frac{1-(-1)^{(n+1)}}{2}\times\left(\frac{A}{2}\right)+(n-1)\times\frac{A}{N},$$

where n is a natural number that is greater than or equal to 2 and that is less than or equal to N.

12. The fin assembly for the heat exchanger according to claim 4, wherein at least two of the plurality of fins have different widths from each other.

13. The fin assembly for the heat exchanger according to claim 4, wherein at least one of the plurality of fins is provided with a louver.

14. The fin assembly for the heat exchanger according to claim 4, wherein in the section perpendicular to the height direction of the fin assembly, surfaces of the fin bodies of at least some of the plurality of fins are inclined to the width direction of the fin assembly towards a same side in the length direction of the fin assembly.

15. The fin assembly for the heat exchanger according to claim 4, wherein in the section perpendicular to the height direction of the fin assembly, a surface of the fin body of at least one, on one side in the width direction of the fin assembly, of the plurality of fins is inclined to the width direction of the fin assembly towards one side in the length direction of the fin assembly, while a surface of the fin body of at least one, on an other side in the width direction of the fin assembly, of the plurality of fins is inclined to the width direction of the fin assembly towards an other side in the length direction of the fin assembly.

16. The fin assembly for the heat exchanger according to claim 4, wherein in the section perpendicular to the height direction of the fin assembly, a surface of the fin body of one of the two adjacent fins is inclined to the width direction of the fin assembly towards one side in the length direction of the fin assembly, while a surface of the fin body of the other of the two adjacent fins is inclined to the width direction of the fin assembly towards the other side in the length direction of the fin assembly.

17. The fin assembly for the heat exchanger according to claim 4, wherein assuming that the plurality of fins are respectively numbered 1st to Nth from one to the other of outmost fins of the plurality of fins, a distance by which the wave crest or the wave trough, on the one side in the height direction of the fin assembly, of the ith fin is staggered relative to the wave crest or the wave trough, on the one side in the height direction of the fin assembly, of the 1st fin in the length direction of the fin assembly is gradually increased by a predetermined increment, and the wave crest, on the one side in the height direction of the fin assembly, of one of the j-1th and jth fins and a wave trough, on the other side in the height direction of the fin assembly, of the other of the j-1th and jth fins are substantially arranged at the same position in the length direction of the fin assembly, where i is an odd number that is greater than or equal to 3 and that is less than or equal to N, while j is an even number that is greater than or equal to 2 and that is less than or equal to N.

18. The fin assembly for the heat exchanger according to claim 17, wherein the predetermined increment is substantially a constant.

19. The fin assembly for the heat exchanger according to claim 4, wherein assuming that the plurality of fins are respectively numbered 1st to Nth from one to the other of outmost fins of the plurality of fins, the wave crest or the wave trough, on the one side in the height direction of the fin assembly, of the ith fin is staggered by a preset distance relative to the wave crest or the wave trough, on the one side in the height direction of the fin assembly, of the 1st fin in the length direction of the fin assembly, and the wave crest, on the one side in the height direction of the fin assembly, of one of the j-1th and jth fins and a wave trough, on the other side in the height direction of the fin assembly, of the other of the j-1th and jth fins are substantially arranged at the same position in the length direction of the fin assembly, where i is an odd number that is greater than or equal to 3 and that is less than or equal to N, while j is an even number that is greater than or equal to 2 and that is less than or equal to N.

20. The fin assembly for the heat exchanger according to claim 19, wherein the distance by which the wave crest or the wave trough, on the one side in the height direction of the fin assembly, of the ith fin is staggered relative to the wave crest or the wave trough, on the one side in the height direction of the fin assembly, of the 1st fin in the length direction of the fin assembly is $$(i-1)\times\frac{A}{N},$$

where A is an average of distances between adjacent ones of the wave crests, on the one side in the height direction of the fin assembly, of the fin assembly.

21. The fin assembly for the heat exchanger according to claim 4, wherein the wave crests or the wave troughs, on the one side in the height direction of the fin assembly, of all of the plurality of fins are staggered by the predetermined distances relative to one another in the length direction of the fin assembly.

22. The fin assembly for the heat exchanger according to claim 4, wherein projections of the wave crests or the wave troughs, on the one side in the height direction of the fin assembly, of all of the plurality of fins on a plane defined by the height direction and the length direction of the fin assembly are arranged at substantially equal intervals in the length direction of the fin assembly.

23. The fin assembly for the heat exchanger according to claim 4, wherein at least one of the plurality of fins is provided with no louver.

24. The fin assembly for the heat exchanger according to claim 4, wherein the plurality of fins are three or more fins.

25. The fin assembly for the heat exchanger according to claim 4, wherein the fin has a sectional shape in a plane that is defined by the width direction of the fin assembly, and at least some of the plurality of fins have substantially the same sectional shape.

26. The fin assembly for the heat exchanger according to claim 4, wherein the fin has a sectional shape in a plane that is defined by the height direction and the length direction of the fin assembly, and at least some of the plurality of fins have substantially the same sectional shape.

27. A heat exchanger, comprising:

heat exchange tubes; and the fin assemblies according to claim 4 which are disposed between the heat exchange tubes.

28. The fin assembly for the heat exchanger according to claim 4, wherein assuming that the plurality of fins are respectively numbered 1st to Nth from one to the other of outmost fins of the plurality of fins, distances by which the wave crests or the wave troughs, on the one side in the height direction of the fin assembly, of the 2nd to Nth fins are staggered relative to the wave crest or the wave trough, on the one side in the height direction of the fin assembly, of the 1st fin in the length direction of the fin assembly are gradually increased by a predetermined increment.

29. The fin assembly for the heat exchanger according to claim 28, wherein the predetermined increment is substantially a constant.

* * * * *